United States Patent [19]

Probst

[11] 4,129,223

[45] Dec. 12, 1978

[54] BUNDLE CARRIER ATTACHMENT FOR FORK LIFT TRUCKS

[75] Inventor: Wallace P. Probst, Marcell, Minn.

[73] Assignee: Robil Company, Minneapolis, Minn.

[21] Appl. No.: 835,688

[22] Filed: Sep. 22, 1977

[51] Int. Cl.[2] ..... B66F 9/06; B66F 9/14

[52] U.S. Cl. ..... 214/620; 214/731

[58] Field of Search ..... 214/620, 621, 730, 731, 214/147 G, 654

[56] References Cited

U.S. PATENT DOCUMENTS

| | | | |
|---|---|---|---|
| 2,605,918 | 8/1952 | Roscoe | 214/731 |
| 3,581,923 | 6/1971 | Archer | 214/620 |
| 3,643,825 | 2/1972 | Zone, Jr. | 214/620 |
| 3,850,322 | 11/1974 | Miles et al. | 214/620 |
| 4,050,599 | 9/1977 | Bender | 214/730 |

OTHER PUBLICATIONS

"Lift Truck Attachments," by Bruce Whitehall, *Mechanical Handling*, May, 1967, pp. 200–204.

*Primary Examiner*—Francis S. Husar
*Assistant Examiner*—Ross Weaver
*Attorney, Agent, or Firm*—Burd, Braddock & Bartz

[57] ABSTRACT

A bundle carrier attachment for a fork lift truck has a longitudinally extending, rectangular horizontal upper framework which is supported on longitudinally extending parallel tines of the fork lift truck. A pair of vertical support legs extend downwardly, one from each end of one longitudinal edge of the horizontal framework, and a bundle carrier tine is rotatably mounted with respect to each of these vertical load support legs in vertically spaced relation generally below one of the fork lift truck tines. These bundle carrier tines are integral with rotatable bundle tine support shafts which extend up inside of vertical support legs to and through the upper horizontal framework of the attachment. Means is provided to rotate these shafts to selectively position these bundle carrier attachment tines in mutually aligned relationship, parallel to the longitudinal edge of the upper framework thus to allow the bundle carrier attachment to be lowered over an elongated bundle to be lifted by manipulation of the fork lift truck tines; and means is provided to rotate these bundle tine support shafts to position the bundle carrier tines in transverse relationship with respect to said elongated bundle and said longitudinal edge of said upper framework when the framework is so positioned as to lie over such a bundle so that the bundle can be lifted and transported by the bundle carrier tines upon manipulation and lifting of the fork lift truck tines.

10 Claims, 5 Drawing Figures

88
28
44
48
90
68
74
66
70
40
30
85
76
10
86
38
58
90
62
64
44
60
18
26
48
16
32
36
22
20
34
14
12
24

FIG. 3
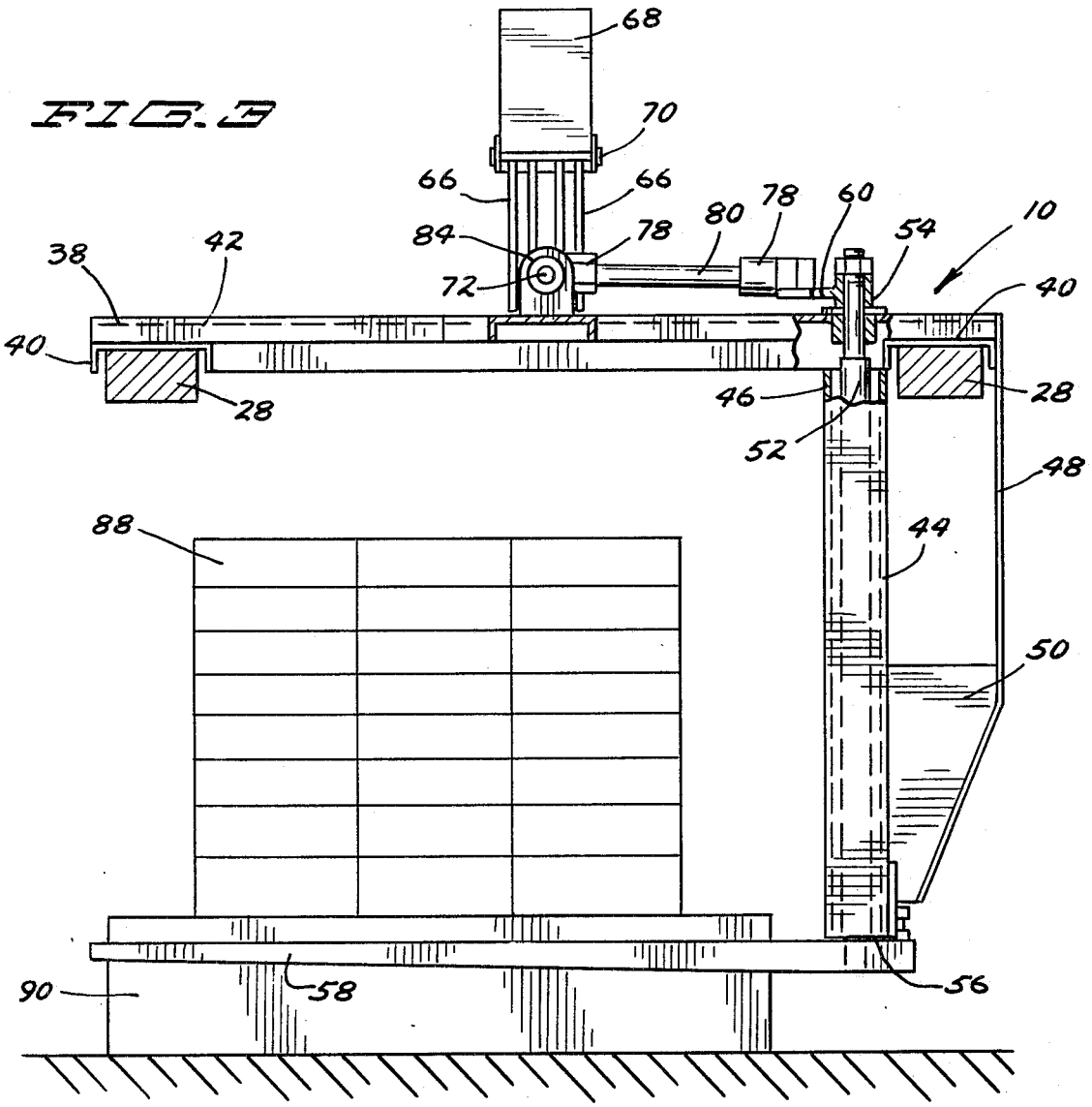
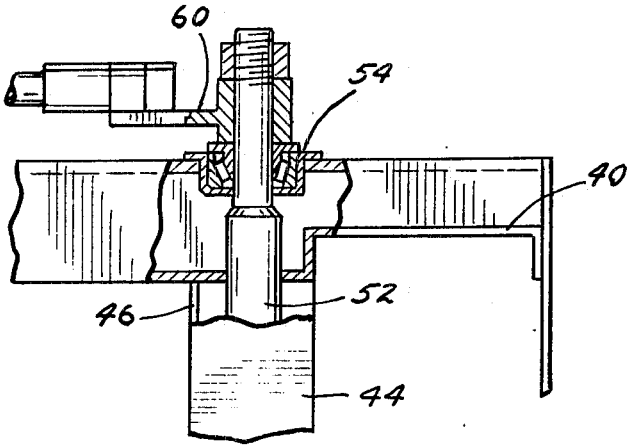
FIG. 4
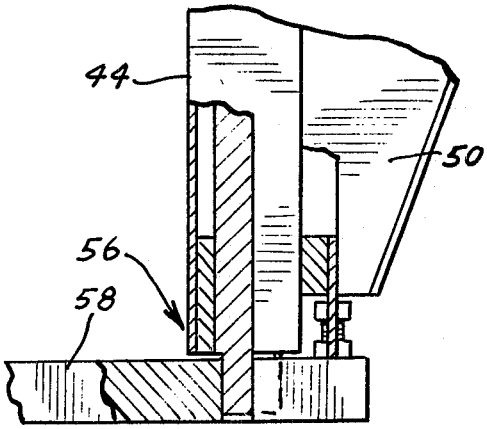
FIG. 5

BUNDLE CARRIER ATTACHMENT FOR FORK LIFT TRUCKS

BACKGROUND OF THE INVENTION

This invention has relation to equipment useful to transport elongated bundles, such as banded lumber and similarly stacked unbanded lumber, and the like, to and from positions of storage or use. Typically, fork lift trucks are used for such a purpose, but, before the present invention, these trucks have to be turned and positioned in transverse relationship to the elongated bundle or lumber stack, for example. The fork lift truck tines are then raised by the lift truck prime mover and the lifted bundle then backed up far enough away from any adjacent bundles or walls so that the truck can back around to a position at 90° from its pick-up position in order to transport the load transversely of the truck to its new location for storage or use. Obviously, the width of the pathway left open for such transportation must be substantially larger than the length of the bundle being transported.

When the bundle reaches its near new location, the fork lift truck must again be turned at 90° to the longitudinal axis of the final resting place of the bundle, the truck and bundle must then be moved up close to any adjacent bundle, and the fork lift truck tines lowered to deposit the bundle on the ground or on bolsters to support it off of the ground.

In supporting such elongated bundles in a yard for storage or in a building for any purpose, in accordance with the prior art, sufficient space must be left between the last elongated bundle deposited and the edge of the yard or the wall of the building behind the truck to allow the fork lift truck room to pull its fork lift truck tines back out from under the bundle, and then to back around at 90° with respect to the bundle discharge position so that the truck can go on to do other work.

Obviously if elongated loads could have been handled by a fork lift truck while the bundles or other loads were in longitudinal alignment with the longitudinal axis of the truck, the work path or pattern of the fork lift truck vehicle would be greatly reduced; bundles could be transported down narrow passages between lumber stacks, and increased storage density and superior stackability could be obtained. The fork lift truck could move to the end of the elongated bundle, pick up the bundle, carry it to the new location for use, put it down again, and back straight away from it.

Something somewhat similar has been quite recently tried and has apparently found some degree of success. An expensive single purpose load handling machine embodying a prime mover or truck with a hydraulically operable extensible load handling knuckle boom thereon is equipped with a rotating lumber grapple attachment at the outer end of the boom. This attachment embodies two support legs having rotatable tines at the bottom thereof, the support legs being designed to be placed by the knuckle boom adjacent the outer longitudinal edge of the bundle to be lifted, and the tines being adapted to be rotated to take position underneath of the bundle. The hydraulically extensible boom is then elevated to raise the bundle, and the knuckle boom is utilized, after the boom is extended, to rotate the elongated bundle on a central vertical axis should this be desirable.

The difficulty with this structure from a practical viewpoint is that the entire large expensive rig must be committed, at least temporarily, to one purpose operation, and the prime mover and the hydraulically operated extensible and elevatable boom cannot be used for other work whenever they are being used to transport elongated bundles longitudinally in line with the prime mover. Changeover from this mode of operation to use in some other manner entails a large changeover or "down" time period. This takes the structure out of the economic reach of the small and medium size operator who needs and uses a fork lift truck for many purposes but has need for moving elongated bundles longitudinally from time to time and on short notice.

Experimentation has been going along with the hydraulic knuckle boom structure as set out above, but it is not known by the present inventor as to whether his invention came before or after the development of it.

Efforts have been made to adapt conventional fork lift truck structures to the handling of elongated bundles in longitudinal alignment with the fork lift truck bodies. See for example U.S. Pat. No. 2,950,830 to Johnson, granted Aug. 30, 1960 and U.S. Pat. No. 2,724,521 to Squires, granted Nov. 22, 1955. Both of these patents try to solve the problem by supporting the elongated bundle or other load in cantilever fashion from one end of the load. Obvious limitations of these structures are the structural strength of the load being lifted, and the movement of the center of gravity of the truck and the load forward as the weight of the load is increased and as the length of the load is increased. Further, the cantilever aspect of the load resting at the end of the tines in downward direction and being forced against the structure above the tines in the upward direction exerts very large and destructive torques on the mechanisms.

Another attempt to use the basic fork lift truck structure to handle enlongated bundles in longitudinal alignment with the truck axis is shown in U.S. Pat. No. 3,984,019 to Brudi, granted Oct. 5, 1976. This is another special purpose attachment which must be connected and disconnected from the front of the fork lift truck with some difficulty and considerable "down" time. Further, this structure relies on a horizontally extending boom which comprises a parallelogram linkage which swings horizontally from side to side to carry a pair of parallel and constantly aligned tines transversely alternately under and out from under a load to be lifted. This structure has the obvious disadvantage of needing the full clearance of the width of the bundle on the working side of the bundle, or it could not be lowered down next to the bundle in the first place and could not be moved clear of the bundle and raised away from it when the bundle reaches its final resting point.

A search was made preparatory to writing this patent application, and the only patents located are the three listed above.

SUMMARY OF THE INVENTION

The bundle carrier attachment of the invention includes a generally horizontal upper framework which is provided with a pair of parallel spaced-apart longitudinal fork lift truck tine receiving receptacles forming outer longitudinal side edges of the framework. A pair of vertical load support legs extend downwardly from opposite end portions of one of the fork lift tine receptacles in the form of the invention as shown; but in a variant form of the invention, another pair of vertical load support legs could extend downwardly from the other fork lift truck tine receptacle.

A bundle carrier tine is rotatably mounted with respect to a bottom portion of each of said vertical load support legs. A bundle carrier tine control shaft is rotatably mounted with respect to the upper framework and with respect to each of the support legs and is operably connected with one bundle carrier tine to cause that tine to rotate responsive to rotation of said shaft. The bundle carrier tine is integral with and extends horizontally outwardly from each of said vertical support legs at right angular relationship with respect thereto.

Means is provided to cause the tine control shafts to locate the bundle carrier tines in a first position transverse in relationship with respect to the longitudinal axis of the horizontal upper framework; and means is provided to move the tine control shafts and the bundle carrier tines from such tine position to a second position under and in parallel alignment with the fork lift truck tine receptacle associated with the vertical support legs and tine control shafts.

In the form of the invention as shown, the means for moving the bundle carrier tines from transverse, bundle-carrying relationship to clearing, mutually aligned relationship under a fork lift truck tine receptacle is constituted as a treadle pivotally mounted with respect to the horizontal upper framework and in position to be pivoted in a first direction upon application of force from the fork lift truck as, for example, by forcing a power actuated bail forming part of the normal fork lift truck assembly down against the treadle. Mechanical linkages are provided, in the form of the invention as shown, for transforming this treadle movement into rotational movement of the tine control shafts to move the shafts and the bundle carrier tines into load clearing, aligned relationship with respect to the longitudinal axis of the bundle carrier attachment.

Also in the form of the invention as shown, the means for positioning and repositioning the bundle carrier tines in transverse, bundle-carrying relationship includes resilient means urging said control linkages in direction to move the attachment tine control shafts to move the bundle-carrier tines toward this transverse relationship. It is to be understood, however, that other means could be employed to achieve these results. For example, the treadle could encompass both sides of the outer bar end of the bail of the fork lift truck, and movement with the attachment tines from mutually aligned, bundle-clearing position to transverse bundle-carrying position could be accomplished by upward movement of this treadle actuated by powered upward force exerted by the bail.

When not in use the attachment can be stored in operating position with the bundle carrier tines supporting it on the floor or ground.

To utilize the bundle carrier attachment of the invention, any fork lift truck can substantially instantaneously pick up the attachment by moving to position to longitudinally align its fork lift truck tines with respect to the fork lift truck tine receiving receptacles. The truck is then moved forward to encompass the truck tines in their receptacles and these truck tines are then elevated to lift the attachment from the ground.

The attachment will next be moved to the location for use, the bundle carrier tines will be moved to their "second position" in mutual vertical alignment under one of the tine receptacles, and the attachment lowered down over a bundle to be moved. When so positioned the bundle carrier tines will be moved to their "first" positions under the load, and then the fork lift truck tines will be used to lift the attachment and bundle and move it to its new position for use.

The bundle carrier tines will then again be moved to their second position and the attachment elevated by the truck to remove it from over the bundle.

To store the attachment, it is simply lowered to the ground, the truck tines lowered until they no longer support the attachment and the truck is backed free to leave the attachment supported on the floor or ground on its bundle carrier tines.

IN THE DRAWINGS

FIG. 1 is a side elevational view of the bundle carrier attachment of the invention shown in relationship to a bundle to be carried and to a fork lift truck to which the bundle carrier attachment is attached;

FIG. 3 is an enlarged vertical cross sectional view taken on the line 3—3 in FIG. 1;

FIG. 4 is a further enlarged fragmentary sectional view also taken on the line 3—3 in FIG. 1, but with parts in section and parts broken away; and FIG. 5 is also an enlarged fragmentary sectional view taken on the line 3—3 in FIG. 1.

DESCRIPTION OF PREFERRED EMBODIMENT

Figure 2:
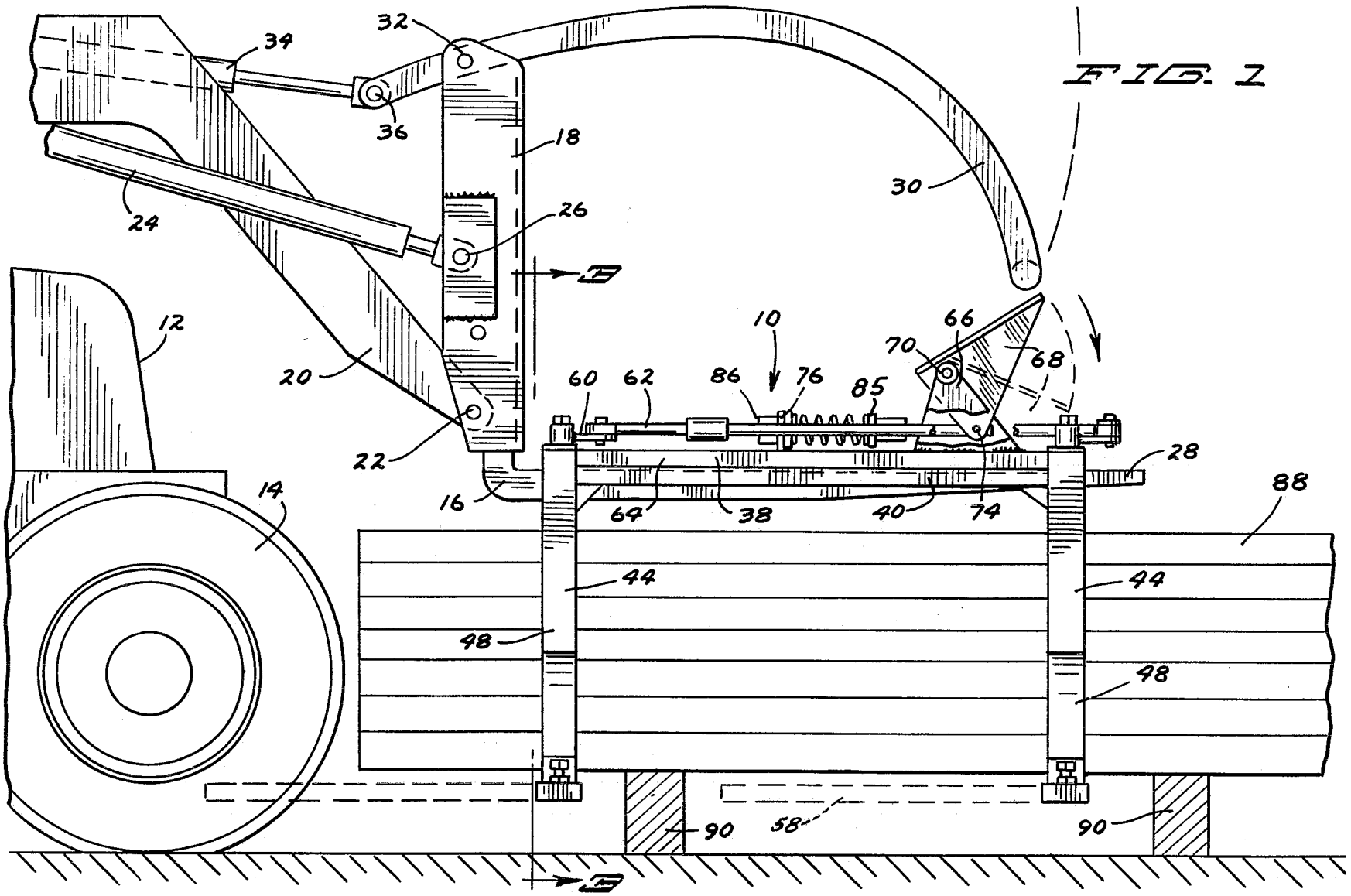
FIG. 2 is a top elevational view of the bundle carrier attachment of FIG. 1 shown in relationship to a lift fork and load retaining bail of the fork lift truck.
Figure 2:
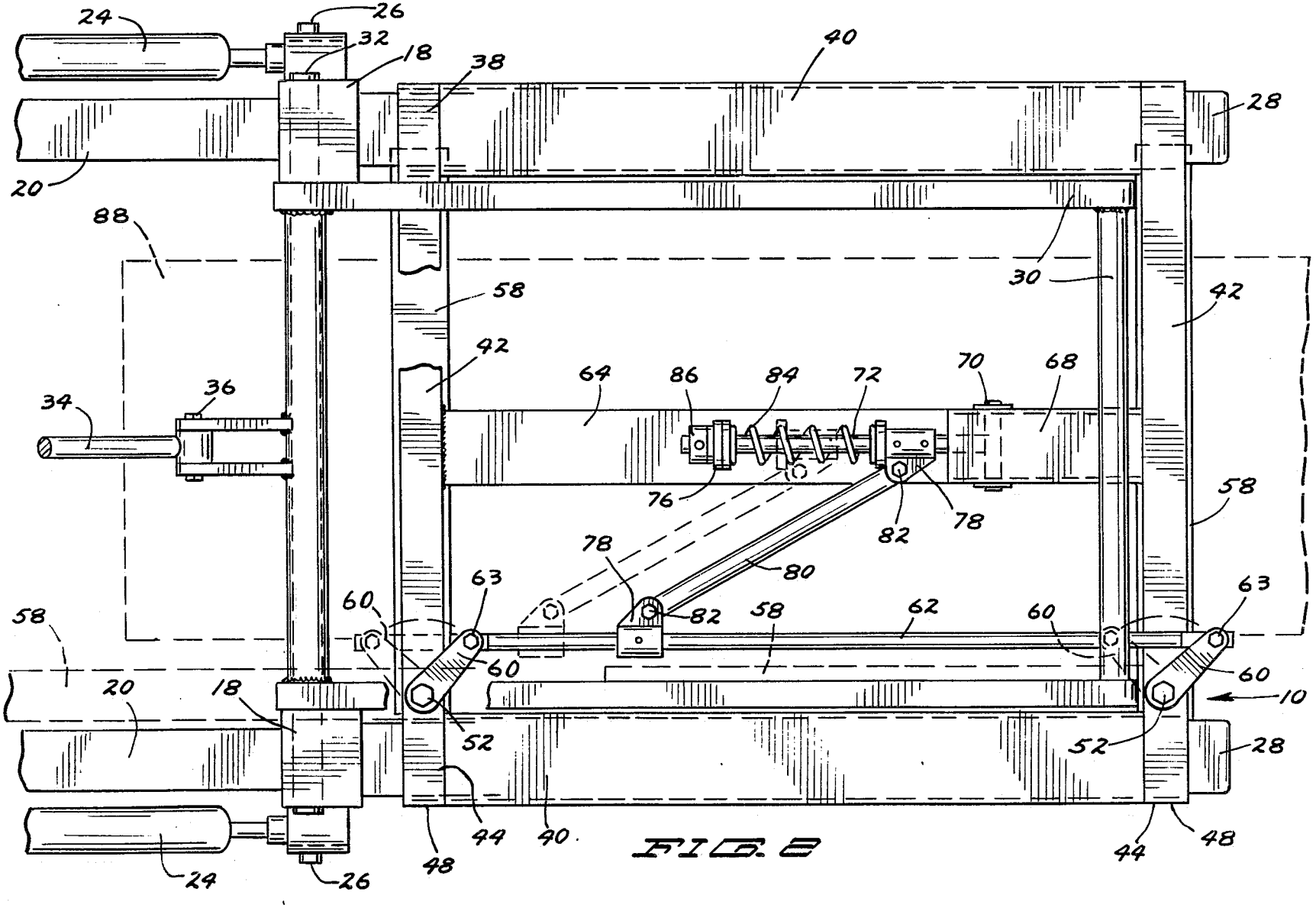

A bundle carrier attachment 10 of the present invention is illustrated in connection with a fork lift truck 12 supported on wheels 14 (one of four being shown), and including a truck lift fork 16. The lift fork 16 includes spaced-apart parallel truck fork lift support columns 18,18. The position of the truck lift fork 16 with respect to the fork lift truck 12 is controlled by hydraulically actuated booms 20,20, which are pivotally mounted to the truck fork lift support columns as at 22; and by linear hydraulic motors 24 (of which one is shown) pivotally mounted to each of the truck fork lift support columns 18,18 as at 26. The truck lift fork 16 includes spaced apart, mutually parallel, fork lift truck tines 28,28.

In the form of the invention as shown, a lift truck load hold-down bail 30 is pivotally mounted between uppermost portions of the truck fork lift support columns 18,18 as at 32; and the position of this bail with respect to the lift truck tines 28,28 is controlled by a linear hydraulic motor 34 which is pivotally mounted to an inner end of the bail 30 as at 36. Opposite ends of hydraulic motors 24 and 34 and the opposite end of the booms 20,20 are operably connected to the fork lift truck 12 in any usual or preferred manner (not shown).

The bundle carrier attachment 10 includes an upper horizontal generally rectangular framework 38 consisting of parallel, spaced apart longitudinally extending frame members or fork lift truck tines receptacles 40,40 and transversely extending front and rear frame spacer bars 42,42. These frame members or fork lift truck tine receptacles 40,40 are constituted as downwardly opening channel irons in the form of the invention as shown, and the transversely extending spacer bars 42,42 are integrally fastened, as by welding, at their outer extremities, each to an outer end portion of a separate one of channel irons.

One of a pair of vertical load support legs 44,44 extends integrally downwardly from end portions of one of the fork lift truck tine receptacles 40, the one to the right as seen in FIG. 3 and from an end of each of the frame spacer bars 42,42 adjacent that receptacle. Each of these vertical support legs 44 includes a hollow tubular vertical load support column 46, a flat vertical load support strap 48 extending integrally down from an outer end face of its associated frame spacer bar 42, and a vertical load support gusset 50 integrally connected, as by welding, with lower end portions of the load support column 46 and on the load support strap 48.

One of a pair of bundle-carrier tine support and control shafts 52,52 is situated in surrounded relationship inside of each of the vertical tubular load support columns 46, and is supported rotatably with respect to the upper framework 38 as at 54 and in the lower end of the vertical support leg 44 as at 56. As best seen in FIG. 4, the support bearing at 54 is so constructed that it resists the vertical loading of the shaft 52 at the same time supporting it for rotation.

Integral with and extending horizontally outwardly from each of the bundle-carrier tine support and control shafts 52,52 is a bundle carrier tine 58.

At the top of each of the tine control shafts 52 is an integral outwardly extending shaft control pivot arm 60, and a shaft control pivot arm tie rod 62 is pivotally mounted as at 63 with respect to outer ends of each pivot arm 60 to insure that each of these pivot arms, and consequently each of the tine control shafts and each of the bundle-carrier tines, move in coordinated parallel relationship one with respect to the other.

The transversely extending front and rear frame spacer bars 42,42 are themselves tied together with a center mounted, longitudinally extending, control linkage support strap or framework spine 64. The support strap 64 and front and rear spacer bars 42,42 are constituted as downwardly opening channel irons in the form of the invention as shown.

A pair of treadle support ears 66,66 are integral with and extend upwardly from the framework spine 64; and a fork lift truck bail receiving treadle 68 is pivotally mounted to upper portions of the ears 66,66 as at 70. A treadle controlled push rod 72 is pivotally connected to a lower portion of the treadle 68 as at 74, and has a forward end thereof slidably mounted in a provided opening in a transverse push rod support ear 76 which is integral with and extends upwardly from longitudinally extending control linkage support strap or framework spine 64.

As best seen in FIG. 2, the treadle controlled push rod 72 and the shaft control pivot arm tie rod 62 are situated to maintain a parallel relationship with respect to each other as they are moved longitudinally with respect to the upper horizontal framework 38 of the bundle carrier attachment 10; and pivot support clamps 78,78 are fixedly mounted, one on the push rod 72 and one on the tie rod 62 to pivotally support a tie rod-push rod link 80 as at 82,82 to transmit longitudinal motion of the push rod 72 to the tie rod 62. A compression coil spring 84 surrounds the push rod 72 and bears on one end against a washer 85 supported against the push rod pivot support clamp 78, and on the other end against the push rod support ear 76. A stop collar 86 is fixedly mounted on the outer end of the push rod 72 to fix the limit of the forward movement of the treadle controlled push rod 72 and hence the uppermost position of the treadle 68. This normal fully extended positioning of the spring 84 and of the push rod 72 and treadle 68 are illustrated in full lines in FIG. 1, while the lower position of the treadle, to which it will be forced by the bail 30 in a manner to be described, is illustrated in dotted lines in that figure.

OPERATION

The operation of the bundle carrier attachment 10 in connection with operation of the fork lift truck 12 will be described in connection with the pick up and movement of an elongated bundle illustrated as stacked lumber 88 supported on transversely extending bolsters 90,90.

Without the bundle carrier attachment of the present invention, in order for the fork lift truck 12 to elevate and transport the elongated bundle 88, the truck lift fork 16 including the spaced apart fork lift truck tines 28,28 would have to be hydraulically lowered, and the truck 12 would have to be brought around into transverse relationship to the elongated bundle of stacked lumber 88. As viewed in FIG. 2, where the elongated bundle 88 is indicated in dotted lines, and clearance between that bundle and any adjacent bundles, fences, or building walls in the direction downward as seen in FIG. 2 would have to be equal to the longitudinal length of the fork lift truck 12 plus the length of the fork lift truck tines 28 and the amount that the hydraulically actuated booms 20,20 extend out in front of the fork lift truck 12. This is to be contrasted with the clearance on the lower side of the elongated bundle 88 as viewed in FIG. 2 and to the right in FIG. 3, this clearance needing only to be the thickness of the vertical load support legs 44 as seen in FIG. 3.

When the bundle carrier attachment 10 is not in use, it can be stored substantially in the position as seen in FIGS. 1 and 3 but with the bundle carrier tines 58 resting on the floor or ground. The fork lift truck, such as the truck 12, being free from bundle carrier attachment 10, can be utilized in its usual manner to handle loads not needing the attachment.

When it is desired to transport an elongated bundle, such as the bundle 88, in longitudinal alignment with the truck 12, the truck 12 will be maneuvered in a position to the left end of the bundle carrier attachment as seen in FIG. 1, and fork lift truck tines 28,28 aligned with receptacles 40,40. The truck will then be moved forward until the truck tines 28 are in the receptacles 40,40 as perhaps best seen in FIGS. 1 and 3. The truck lift fork 16 is then elevated to move the bundle carrier tines 58 into clearing relationship to the ground, and then the truck is used to move the attachment 10 into longitudinal alignment over and along side an elongated bundle 88 to be moved.

The lift truck load hold down bail 30 is then depressed by actuation of the linear hydraulic motor 34 to come into contact with the fork lift truck bail receiving treadle 68 to move that treadle from position as seen in full lines in FIG. 1 to positions as seen in dotted lines in that figure. This causes the treadle to move the treadle controlled push rod 72 to the left as seen in FIGS. 1 and 2 against the action of compression coil spring 84. Acting through the tie rod-push rod link 80, this causes the shaft control pivot arm tie rod 62 to be moved to the left as seen in those figures, moving shaft control pivot arms 60,60 from position as seen in full lines in FIG. 2 to position as seen in dotted lines in that figure.

This movement, as seen in FIG. 2, causes a rotation of the attachment tines support and control shafts 52,52 through 90°. The bundle carrier tines 58,58, being integral with these tine control shafts 52,52, likewise are rotated 90°, from their normal transverse position with respect to the longitudinal axis of the bundle carrier attachment 10 as seen in full lines, to the position in alignment with the longitudinal axis of the bundle carrier, and in direct mutual alignment with each other along the longitudinal edge of the attachment, as seen in dotted lines in FIGS. 1 and 2.

With the bundle carrier tines 58,58 in clearing relationship out from under the upper horizontal framework 38 of the bundle carrier attachment 10, the bundle carrier attachment is moved up over the elongated bundle 88 and then lowered down to put the vertical load support legs 44,44 in spaced relationship alongside the elongated load as shown in FIG. 3, and to place the horizontal upper framework 38 in parallel horizontal relationship over the elongated bundle also as seen in FIG. 3 and as seen in FIG. 1.

With the bundle attachment so positioned by the fork lift truck 12 and the fork lift truck tines 28,28, and with the bundle carrier tines 58,58 in position lower than the bottom surface of the elongated bundle to be lifted and transported, the lift truck bail 30 will be lifted from the treadle 68 to allow the spring 84 to force the push rod pivot support clamp 78 and the push rod 72 to move to the right as seen in FIGS. 1 and 2. This moves the tie rod 62 to the right rotating the shaft pivot arms 60 and integrally connected bundle carrier tine control shafts 52 in clockwise direction as seen in FIG. 2, thus rotating the bundle carrier tines 58 from aligned relationship with longitudinal axis of the bundle carrier attachment 10 to the transverse relationship with respect thereto as seen in full lines in FIGS. 2 and 3.

The fork lift truck tines 28,28 are then lifted by the mechanism of the fork lift truck 12 to bring the bundle carrier tines 58,58 into supporting and lifting relationship with respect to the elongated bundle of stacked lumber 88, for example, to lift and to transport that bundle.

In the event that the elongated bundle is being picked up in a restricted area where there is very little clearance to either side, the fork lift truck 12 will simply be moved straight back in direction away from the elongated bundle, but carrying that bundle with it, to withdraw the bundle from the restricted location. The fork lift truck will then be used to transport the bundle to the desired new location, for example, in a restricted location with very little clearance to either side of the bundle; the bundle carrier attachment will be lowered slightly to put the elongated bundle 88 back down on other bolsters such as shown at 90,90, and then bail 30 of the fork lift truck will again be forced down against the treadle 68 to once again rotate the bundle carrier tines 58 into longitudinal alignment with the axis of the bundle carrier attachment and into clearing relationship with respect to the elongated bundle. The carrier attachment 10 will again be lifted clear of the elongated bundle and moved off to pick up other bundles or to be stored resting on its attachment tines back in transverse relationship until it is again to be used.

The embodiments of the invention in which an exclusive property or privilege is claimed are defined as follows:

1. A bundle carrier attachment for use with a fork lift truck having at least two power operated, vertically movable, fork lift truck tine means extending substantially horizontally ahead of the truck in direction longitudinally of the axis of movement of the truck, said bundle carrier attachment including:

A. An upper framework including a longitudinally extending fork lift truck tine receptacle for each fork lift truck tine means, each said receptacle having a central longitudinal axis said framework having at least a first longitudinally extending framework member adjacent and parallel to a first of said fork lift truck tine receptacles, said first framework member forming a first longitudinal edge portion of the upper framework;

B. at least two vertical, spaced apart, load support legs integral with said framework and extending downwardly from positions adjacent opposite end portions of said first framework member, said load support legs both lying in a single vertical plane parallel to and spaced from the central longitudinal axis of each said tine receptacle;

C. at least two bundle carrier tine control shafts each rotatably mounted with respect to said upper framework and with respect to one of said support legs;

D. at least two bundle carrier tines each supported at one end with respect to a bottom portion of one of said vertical load support legs for rotation about a vertical axis and operably associated with lower portions of said shafts to be rotatable upon rotation of said shafts between a first position wherein said bundle carrier tines are in mutually parallel relation to each other and in transverse relation to said first longitudinally extending framework member and a second position wherein said bundle carrier tines are in mutually aligned relation with each other and in parallel and substantially vertically aligned relation below said framework member; and E. means mounted with respect to said framework for rotating said shafts to move said bundle carrier tines between said first and said second positions.

2. The bundle carrier attachment of claim 1 wherein the fork lift truck with which it is attached includes a power-operated load hold-down bail movable from above the fork lift truck tines in a first direction toward said truck tines and in second direction away from said truck tines; and F. wherein said means for rotating said bundle tine control shafts includes a treadle operably mounted to said framework to be in alignment with said bail as it moves in said first and second directions, and mechanisms between said treadle and said shafts and mounted on said attachment for translating treadle movement responsive to bail movement in a first of said directions into bundle carrier tines movement to said first position and treadle movement responsive to bail movement in a second of said directions into bundle carrier tines movement to said second position.

3. The bundle carrier attachment of claim 2 wherein:

G. the treadle is pivotally mounted with respect to said framework;

H. a push rod is slidably mounted with respect to said framework and is mounted with respect to said treadle in such a manner as to translate pivotal movement of said treadle into linear movement of said push rod;

I. a shaft control pivot arm is integrally connected to an upper portion of each bundle carrier tine control shaft and extends horizontally outwardly therefrom; and J. linkage means connects said push rod and each of said shaft control pivot arms in such a manner as to translate linear movement of said push rod into rotational movement of said control shafts.

4. The bundle carrier attachment of claim 3 wherein:

K. said treadle is rotated in downward direction by said bail as the bail moves in said first direction; and L. resilient means is provided on said attachment to cause said treadle to be rotated in upward direction responsive to movement of said bail in said second direction.

5. The bundle carrier attachment of claim 1 wherein:

F. said first longitudinally extending framework member forms a first of said fork lift truck tine receptacles; and G. said framework includes a second longitudinally extending framework member, parallel to and spaced from said first framework member, forming a second longitudinal edge portion of said framework and forming a second of said fork lift truck tine receptacles.

6. The bundle carrier attachment of claim 5 wherein:

H. said first and second fork lift tine receptacles are constituted as downwardly opening channel irons.

7. A bundle carrier attachment for use with a fork lift truck having at least two power operated, vertically movable, fork lift truck tine means extending substantially horizontally ahead of the truck in direction longitudinally of the axis of the movement of the truck, said fork lift truck also having a power-operated load hold-down bail movable from above the fork lift truck tine means in a first direction toward said truck tine means and in a second direction away from said truck tine means, said bundle carrier attachment including:

A. an upper framework including a longitudinally extending fork lift truck tine receptacle for each fork lift truck tine means, said framework having at least a first longitudinally extending framework member forming a first longitudinal edge portion thereof;

B. at least two vertical, spaced-apart, load support legs integral with said framework and extending downwardly from positions adjacent said framework member;

C. at least two bundle carrier tine control shafts each rotatably mounted with respect to said upper framework and with respect to one of said support legs;

D. at least two bundle carrier tines each supported at one end with respect to a bottom portion of one of said vertical load support legs for rotation about a vertical axis and operably associated with lower portions of said shafts to be rotatable upon rotation of said shafts between a first position wherein said bundle carrier tines are in mutually parallel relation to each other and in transverse relation to said first longitudinally extending framework member and a second position wherein said bundle carrier tines are in mutually aligned relation with each other and in parallel and substantially vertically aligned relation below said framework member;

E. means mounted with respect to said framework for rotating said shafts to move said bundle carrier tines between said first and said second positions, said means including a treadle operably mounted to said framework to be in alignment with said bail as it moves in said first and second directions, and mechanisms between said treadle and said shafts and mounted on said attachment for translating treadle movement responsive to bail movement in a first of said directions into bundle carrier tine movement to said first position and treadle movement responsive to bail movement in a second of said directions into bundle carrier tine movement to said second position.

8. The bundle carrier attachment of claim 7 wherein:

F. the treadle is pivotally mounted with respect to said framework;

G. a push rod is slidably mounted with respect to said framework and is mounted with respect to said treadle in such a manner as to translate pivotal movement of said treadle into linear movement of said push rod;

H. a shaft control pivot arm is integrally connected to an upper portion of each bundle carrier tine control shaft and extends horizontally outwardly therefrom; and I. linkage means connects said push rod and each of said shaft control pivot arms in such a manner as to translate linear movement of said push rod into rotational movement of said control shafts.

9. The bundle carrier attachment of claim 8 wherein:

J. said treadle is rotated in downward direction by said bail as said bail moves in said first direction; and K. resilient means is provided on said attachment to cause said treadle to be rotated in upward direction responsive to movement of said bail in said second direction.

10. A bundle carrier attachment for use with a fork lift truck having at least two power operated, vertically movable, fork lift truck tine means extending substantially horizontally ahead of the truck in direction longitudinally of the axis of the truck, said bundle carrier attachment including:

A. an upper framework including means for receiving said fork lift truck tine means, said framework having at least a first longitudinally extending framework member adjacent and parallel to said means for receiving said fork lift truck tine means, said first framework member forming a first longitudinal edge portion of the upper framework;

B. at least two vertical, spaced-apart, load support legs integral with said framework and extending downwardly from positions adjacent said framework member;

C. at least two bundle carrier tines each supported at one end with respect to a bottom portion of one of said vertical load support legs for rotation about a vertical axis; and D. bundle carrier tine control means mounted with respect to said framework and said support legs to rotate said bundle carrier tines between a first position wherein said bundle carrier tines are in mutually parallel relation to each other and in transverse relation to said first longitudinally extending framework member and a second position wherein said bundle carrier tines are in mutually aligned relation with each other and in parallel and substantially vertically aligned relation below said framework member.

* * * * *